US005896109A

United States Patent [19]

Hachiga et al.

[11] Patent Number: 5,896,109

[45] Date of Patent: Apr. 20, 1999

[54] ANTENNA FOR RADIO COMMUNICATION EQUIPMENT HAVING IMPROVED IMPEDANCE ADJUSTMENT

[75] Inventors: Hitoshi Hachiga; Hideyuki Ogawa; Toshiaki Yuasa, all of Chiba, Japan

[73] Assignee: Uniden Corp., Tokyo, Japan

[21] Appl. No.: 08/930,193

[22] PCT Filed: Feb. 20, 1997

[86] PCT No.: PCT/JP97/00455

§ 371 Date: Oct. 15, 1997

§ 102(e) Date: Oct. 15, 1997

[87] PCT Pub. No.: WO97/31404

PCT Pub. Date: Aug. 28, 1997

[30] Foreign Application Priority Data

Feb. 23, 1996 [JP] Japan ..... 8-036977

[51] Int. Cl.[6] ..... H01Q 9/42; H01Q 1/24

[52] U.S. Cl. ..... 343/702; 343/700 MS; 343/846

[58] Field of Search ..... 343/702, 830, 343/846, 700 MS File; 455/89, 90; H01Q 9/42, 1/24

[56] References Cited

U.S. PATENT DOCUMENTS

| | | | |
|---|---|---|---|
| 4,516,127 | 5/1985 | Siwiak | 343/702 |
| 4,803,491 | 2/1989 | Hikuma | 343/702 |
| 5,148,181 | 9/1992 | Yokoyama et al. | 343/702 |
| 5,764,190 | 6/1998 | Murch et al. | 343/702 |

FOREIGN PATENT DOCUMENTS

| | | |
|---|---|---|
| 46-10243 | 4/1971 | Japan . |
| 60-7204 | 1/1985 | Japan . |
| 62-262502 | 5/1986 | Japan . |
| 63-9206 | 6/1986 | Japan . |
| 2-55961 | 11/1987 | Japan . |
| 63-78447 | 5/1988 | Japan . |
| 2-066011 | 5/1990 | Japan . |
| 3-50901 | 3/1991 | Japan . |
| 4-058603 | 2/1992 | Japan . |
| 4-39711 | 4/1992 | Japan . |
| 4-185003 | 7/1992 | Japan . |
| 4-237220 | 8/1992 | Japan . |
| 7-20771 | 4/1995 | Japan . |

OTHER PUBLICATIONS

Electro Communication Society Corporation "Antenna Engineering Handbook", Oct. 30, 1980, pp. 114–117; ISBN 4–274–02677–9.

*Primary Examiner*—Hoanganh Le
*Attorney, Agent, or Firm*—McDermott, Will & Emery

[57] ABSTRACT

The present invention provides an antenna for radio communication equipment used as an antenna for portable radio equipment or the like which has been required to be downsized. The antenna comprises a ground horizontal surface section, a main erecting surface section connected to the ground horizontal surface section and extending in a direction perpendicular to the ground horizontal surface section, an auxiliary erecting surface section with one edge thereof facing via a power feed point to ground potential and the other edge thereof extending substantially in parallel to the main horizontal surface section, an auxiliary horizontal surface section connected to the auxiliary erecting surface and extending at a specified clearance with the main horizontal surface section, a connecting section connected to the ether edge of the main horizontal surface section as well as to the other edge of the auxiliary horizontal surface section and extending in a direction perpendicular thereto, and a second extending section connected at right angles to the connecting section and extending in a direction substantially parallel to the ground horizontal surface section, and these components are monolithically formed with a sheet of electrically conductive plate.

8 Claims, 6 Drawing Sheets

ANTENNA FOR RADIO COMMUNICATION EQUIPMENT HAVING IMPROVED IMPEDANCE ADJUSTMENT

TECHNICAL FIELD

The present invention relates to an antenna for radio communication equipment, and more particularly to an antenna for portable radio communication equipment or the like required to be minimized, has high-flexibility in adjustment of impedance and a central frequency in a resonance system of an antenna even if a dimension of the antenna is under certain restrictions, and can flexibly be designed.

BACKGROUND ART

There currently exists various types of panel antenna, such as a reversed L-type of or a reversed F-type of antenna which are small and suitable for incorporation into portable equipment as an antenna for radio communication equipment, for instance, radio equipment and a transceiver each mounted on a vehicle, a cordless telephone set, mobile radio equipment, or portable radio equipment each of which is growing in use for a general purpose.

As improvement in the panel antennas, there has been disclosed configuration of an antenna for radio communication equipment, in Japanese Patent Publication No. HEI 2-55961. The antenna can easily match impedances, in other words, has high-flexibility in adjustment of antenna-impedance, and is well suited for size reduction even if a geometrical dimension of a main component of the antenna and a position for taking out a feeding point are restricted.

FIG. 7 schematically shows the configuration of the conventional type of antenna applied to a cordless telephone set. In FIG. 7, the antenna in the example comprises a conductive main erecting surface section 711 with one edge thereof connected to a shield housing 730 which is a ground conductor and erecting to the other edge thereof by a height H; a conductive main horizontal surface section 712 having a width W with one edge thereof connected to the other edge of the main erecting surface section 711, crossing the main erecting surface 711 at right angles and horizontally extending to the other edge thereof by a length H; a conductive auxiliary erecting linear section 713 with one edge thereof connected to the shield housing 730 via a feeding point 720, and linearly extending to the other edge thereof in parallel to the main horizontal surface section 712; a conductive auxiliary horizontal linear section 714 with one edge thereof connected to the other edge of the auxiliary erecting linear section 713, said conductive auxiliary horizontal linear section linearly extending, at a specified space to the main horizontal surface section 712, to the other edge thereof in parallel to the main horizontal surface section 712; a linking section 715 for electrically connecting the other edge of the auxiliary horizontal linear section 714 to a position of the other edge of the main horizontal surface section 712 or a position at a specified space from the position of the other edge thereof; a first conductor width section 716 having a width t1 provided along the whole length or a portion of the length of the auxiliary horizontal linear section 714 and constituting a capacitor for adjusting impedance; and a second conductor width section 717 having a width t2 provided along a portion of the length of the auxiliary horizontal linear section 714 and constituting a capacitor for adjusting a central frequency.

In the antenna based on the conventional technology described above, impedance can be adjusted by (1) adjusting a distance between the auxiliary horizontal linear section 714 and the main horizontal surface section 712, (2) adjusting a position at which the auxiliary horizontal linear section 714 is connected to the main horizontal surface section 712 via the linking section 715, (3) adjusting a capacity according to a width t1 and a length of the first conductor width section 716, and (4) adjusting a position of forming the second conductor width section 717 according to change in a longitudinal direction of the auxiliary horizontal liner section 714.

Also, in a case where the second conductor width section 717 is provided right under the other edge of the main horizontal surface section 712 in which a voltage value becomes a maximum, central frequency in a resonance system of the antenna can be adjusted according to adjustment of the width t2 and a dimension of the area.

In the conventional type of antenna for radio communication equipment as described above, a main erecting surface section and a ground conductor each connected to a feeding point comprise a shield housing for shielding circuit components mounted on a printed board, so that restriction is added to the design that the upper edge surface portion of the shield housing facing to the main horizontal surface section should be formed in parallel to the main horizontal surface section, which lowers the flexibility of the designing, and it is difficult to uniformly form a ground potential surface facing to the main horizontal surface section and in parallel thereto.

Also, the auxiliary erecting linear section, auxiliary horizontal linear section, linking section, first conductor width section, and second conductor width section each one of an antenna for radio communication equipment are formed on the printed board, so that, in designing an antenna as well as a printed board design, designing restrictions are added to each design, and for this reason, design flexibility as a whole radio communication equipment is lowered.

Accordingly, the invention is made to solve the above-described problems and it is an object of the present invention to provide an antenna for radio communication equipment which has high designing flexibility and is excellent in manufacturing workability because only an antenna therein can be designed independently from the other components by forming a ground potential surface in substantially parallel to the main horizontal surface section monolithically formed with the antenna.

Also, it is another object of the present invention to provide an antenna for radio communication equipment which can flexibly be designed because the antenna has high flexibility in adjustment of an impedance and a central frequency in a resonance system of the antenna even if dimensions of the antenna are under certain restrictions.

Further, it is another further object of the present invention to provide an antenna for radio communication equipment in which components each constituting the antenna are monolithically formed, and an antenna can be designed separately from other portions of the radio communication equipment, so that high flexibility in designing can be achieved as a whole radio communication equipment.

DISCLOSURE OF INVENTION

The present invention enables impedance adjustment in many ways, such as by adjusting a clearance between a main horizontal surface section and an auxiliary horizontal surface section, or a length of the main horizontal surface section or auxiliary horizontal surface section and that of a connecting section (or a length of a connecting section and that of a first extending section). Impedance adjustments can also be made by adjusting an area ratio of the main horizontal surface section vs. auxiliary horizontal surface section, or by adjusting a length of a second extending section. Hence, the present invention is capable of providing an antenna, for radio communication equipment, with a high degree of freedom for making impedance adjustments.

In the present invention, a ground potential surface as a ground horizontal surface section required to be substantially parallel to the main horizontal surface section is monolithically formed with other components of the antenna for radio communication equipment, so that the antenna itself can independently be designed, and a freedom degree in designing the entire radio communication equipment is high, and further as the antenna is designed with a sheet of electrically conductive plate, so that an antenna for radio communication equipment excellent in manufacturing workability can be provided.

In the present invention, components of the antenna for the radio communication equipment are provided all around a supporting section, so that it is possible to provide an antenna which can easily be attached to a housing and is excellent in the workability.

BRIEF DESCRIPTION OF THE DRAWINGS

FIG. 1(*b*) is a perspective view of a supporting member for an antenna according to the present invention.

FIG. 1(*c*) is a perspective view of the antenna mounted on a supporting member.

FIG. 1(*d*) is a perspective view showing another type of antenna mounted on the support member.

FIG. 2(*b*) is a rear elevational view thereof.

FIG. 2(*c*) is a front elevational view thereof.

FIG. 2(*d*) is a left side elevational view thereof.

FIG. 2(*e*) is a right side view thereof.

FIG. 3(*b*) is a cross-sectional side view thereof.

FIG. 3(*c*) is a top plan view thereof.

BEST MODE FOR CARRYING OUT THE INVENTION

Detailed description is made hereinafter for outline and embodiments of the antenna for radio communication equipment according to the present invention with reference to the related drawings in the order thereof.

Figure 1:
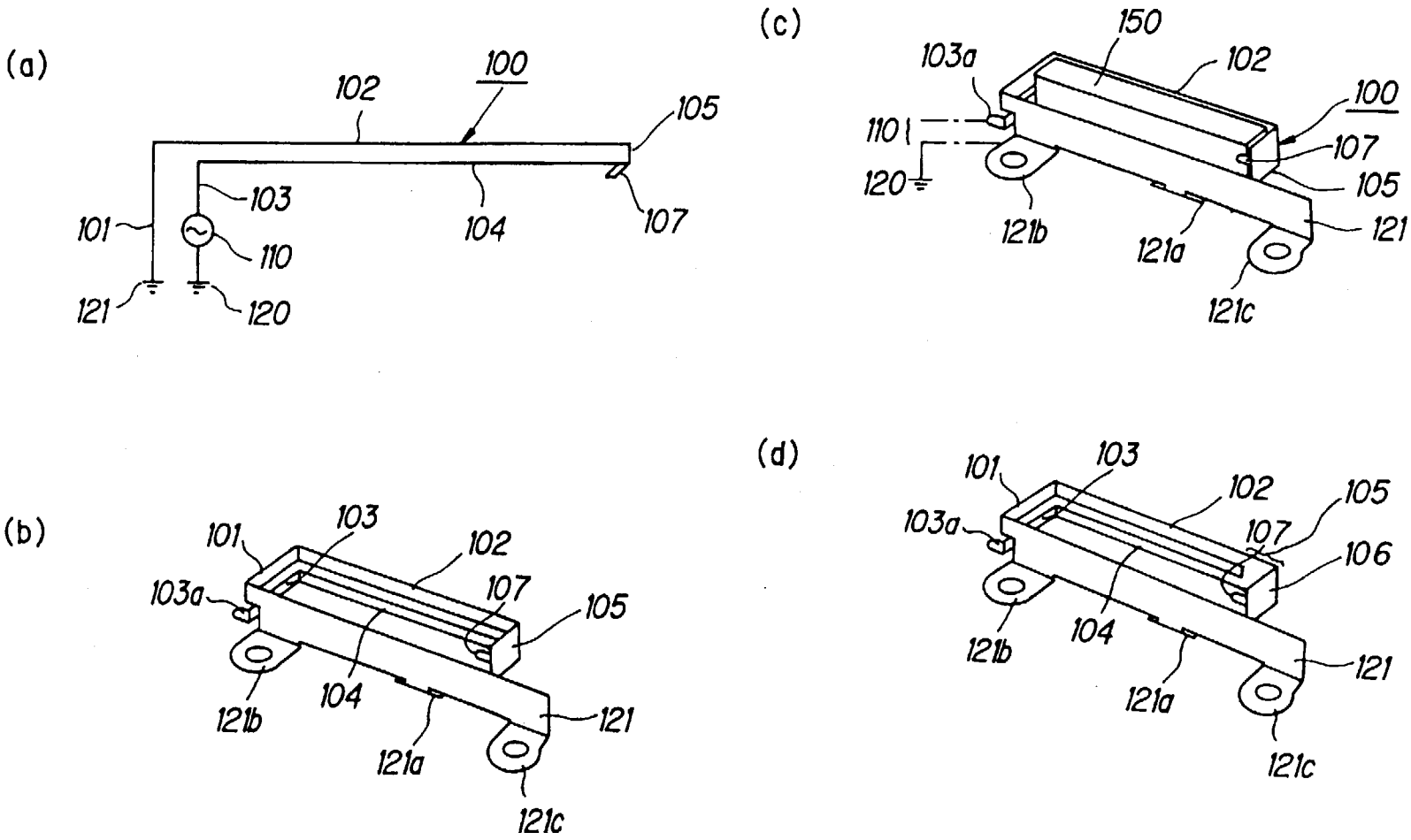
FIG. 1(*a*) is an exemplary equivalent circuit.

FIGS. 1(*a*)–1(*d*) illustrate the configuration of an antenna for a radio communication equipment, according to the present invention. Referring to FIGS. 1(*a*) and 1(*b*), the antenna for radio communication equipment according to the fourth, fifth, and sixth features of the present invention, comprises a ground horizontal surface section 121 for maintaining a ground potential. A main erecting surface section 101 is connected to and extends from the ground horizontal surface section 121 at substantially right angles. A main horizontal surface section 102 is connected to and extends from the main erecting surface section 101 at substantially right angles. An auxiliary erecting surface section 103 is provided with one edge thereof facing a ground potential 120 via a feeding point 110 and the other edge thereof extending substantially parallel to the main erecting surface section 101. An auxiliary horizontal surface section 104 is connected to the auxiliary erecting surface section 103 and extends at a specified space from the main horizontal surface section 102. A linking section 105 is connected to an edge of the main horizontal surface section 102 as well as the other edge of the auxiliary horizontal surface section 104. The linking section 105 crosses and extends from the main horizontal surface section 102 and the auxiliary horizontal surface section 104 at substantially right angles. A second extending section 107 is connected to the linking section 105 at substantially right angles, and extends in manner substantially parallel to the ground horizontal surface section 121.

In the antenna for radio communication equipment according to, especially, the fifth and sixth features of the present invention, as shown in FIG. 1(*c*), in order to support the antenna by a supporting section 150 that provides supporting side faces provided inside of a frame of a main body of the radio communication equipment, each component thereof is formed so that the main erecting surface section 101 and auxiliary erecting surface section 103 face a first side face of the supporting section 150. The main horizontal surface section 102 and auxiliary horizontal surface section 104 face a second side face thereof. The linking section 105 faces a third side face thereof, and the second extending section 107 faces to a fourth side face thereof respectively.

Also in the antenna 100 according to, especially, the sixth feature of the present invention, the ground horizontal surface section 121, the main erecting surface section 101, the main horizontal surface section 102, the auxiliary erecting surface section 103, the auxiliary horizontal surface section 104, the linking section 105, and the second extending section 107 are monolithically formed with a sheet of conductive plate.

Figure 2:
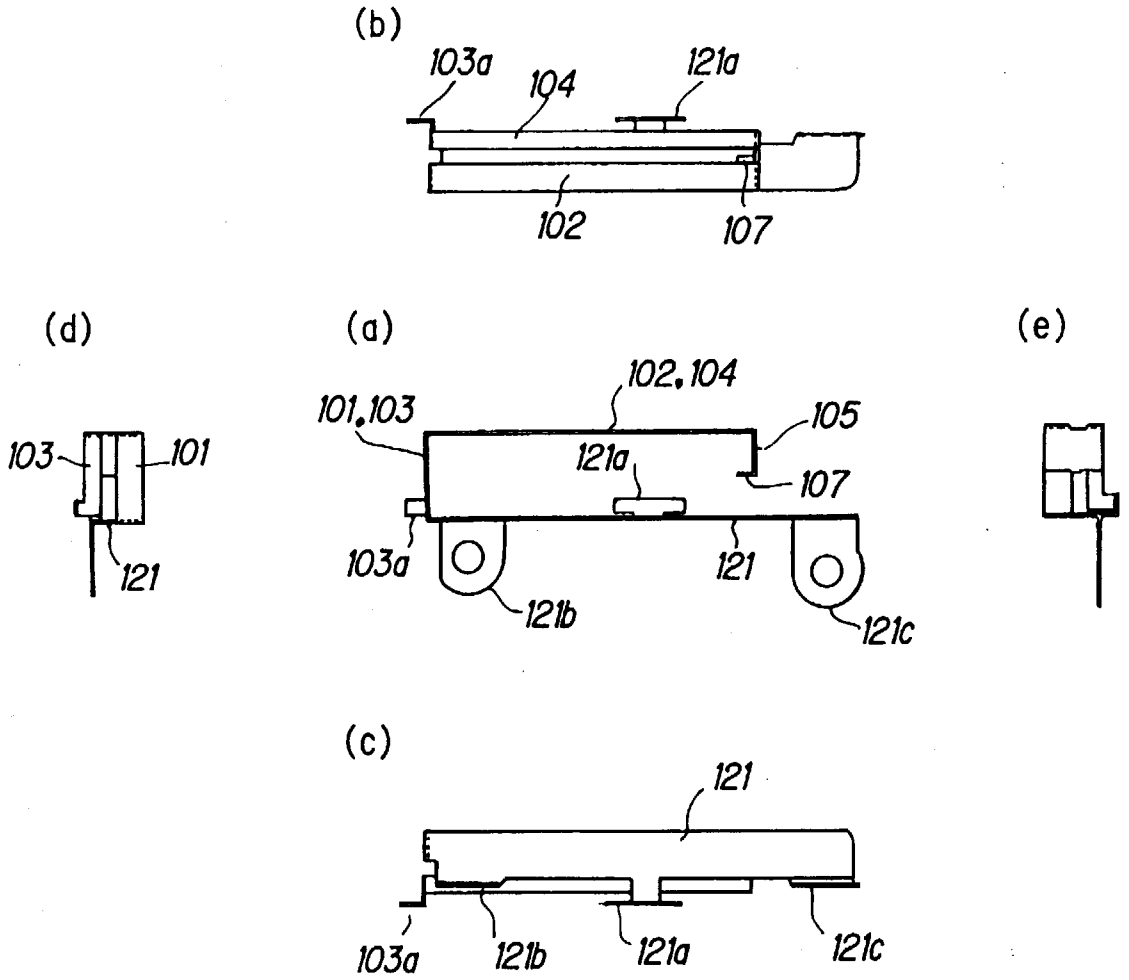
FIG. 2(*a*) is a top plan view of the supporting member.

In the antenna for radio communication equipment according to the first, second, and third features of the present invention, as shown in FIG. 1(*d*), in a case where it corresponds to the antenna for radio communication equipment according to the fourth, fifth, and sixth features shown in FIG. 1(*b*), (*c*) and FIG. 2, respectively, it is assumed that the linking section 105 is formed so as to be connected to the other edge of the main horizontal surface section 102 as well as the other edge of the auxiliary horizontal surface section 104, and so as to extend in the same plane as the main and auxiliary horizontal surface sections. A section (linking section) indicated by the reference numeral 105 in FIG. 1(*b*), (*c*) and FIG. 2 is defined as a first extending section 106.

Referring additionally to FIGS. 2(*a*)–2(*e*), the antenna 100 for radio communication equipment according to the seventh feature of the present invention comprises the ground horizontal surface section 121, main erecting surface section 101, main horizontal surface section 102, auxiliary erecting surface section 103, and auxiliary horizontal surface section 104. The antenna 100 may further comprise, for instance, the linking section (corresponding to sections indicated by the reference numerals 105 and 106 in FIG. 1(*d*) respectively) connected to the other edge of the main horizontal surface section 102 as well as the other edge of the auxiliary horizontal surface section 104, linking section formed so as to be present in a same plane as the main and auxiliary horizontal surface sections and to extend in a plane crossing the plane described above at right angles. The antenna for radio communication equipment according to the eighth feature is constructed by adding the first extending section (for instance, corresponding to a section indicated by the reference numeral 107 in FIG. 1(*d*)) to the antenna for radio communication equipment according to the seventh feature. It should be noted that the configuration shown in FIG. 1(*b*) is also one of the embodiments of the antenna for radio communication equipment according to the seventh and eighth features of the present invention.

With the configuration described above, in the antennas for radio communication equipment according to the first, second, third, fourth, fifth, sixth, seventh, eighth, ninth, and tenth features of the present invention, impedance can be adjusted in many ways, including adjustment of a specified space of the auxiliary horizontal surface section 104 to the main horizontal surface section 102. Likewise, impedance can be adjusted by adjusting a length of the main horizontal surface section 102 or the auxiliary horizontal surface section 104, or of the linking section 105 (or the linking section and the first extending section in the antennas for radio communication equipment according to the first, second, third, eighth, and ninth features of the present invention. In addition, impedance can be changed by adjusting an area ratio by the main horizontal surface section 102 as well as by the auxiliary horizontal surface section 104. Further, in the antennas 100 according to the first, second, third, fourth, fifth, sixth, and ninth features of the present invention, impedance can also be adjusted by adjusting a length of the second extending section 107.

Especially, in the antenna for radio communication equipment according to the ninth feature of the present invention, a central frequency in a resonance system of the antenna can be adjusted by adjusting a length of the second extending section 107 or a dimension of an area thereof.

In the antennas for radio communication equipment according to the third, sixth, seventh, and eighth features of the present invention, as shown in FIG. 1 and FIG. 2, a ground potential surface to be in substantially parallel with the main horizontal surface section 102 is monolithically formed as the ground horizontal surface section 121 with other components in the antenna 100, so that only an antenna itself can be designed without giving any influence to a form design of a shield housing like that based on the conventional technology. Accordingly, design flexibility for the whole radio communication equipment can be achieved. In addition, the antenna 100 is monolithically formed with a sheet of conductive plate, and for this reason an antenna 100 can be formed by simple manufacturing processes where, for instance, fold-forming is performed after press-forming. Hence, it is possible to realize an antenna for radio communication equipment that is excellent in manufacturing workability.

Furthermore, in the antennas according to the second, third, fifth and sixth features of the present invention, as shown in FIG. 1(*c*), components of the antenna 100 are constructed by facing four sides faces of the supporting section 150, so that the antenna 100 can be securely fixed. Excellent workability in mounting work of the antenna 100 can also be realized. Accordingly, the second extending section 107 has a function of adjusting a central frequency and also has a function as a stopper.

Figure 4:
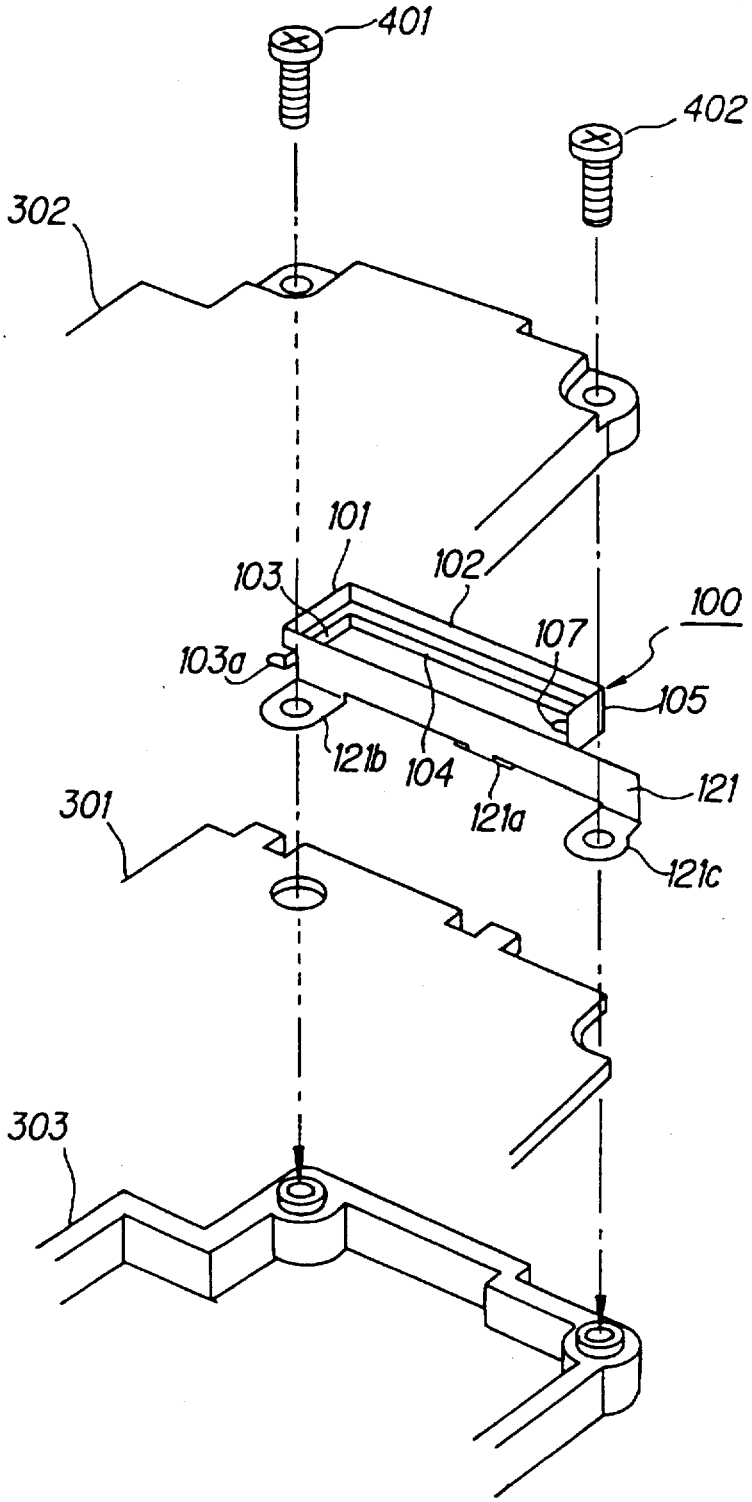
FIG. 4 is an exploded view illustrating how the antenna is mounted onto the housing.

In the antenna for radio communication equipment according to the tenth feature of the present invention, as shown in FIG. 1 and FIG. 4, the antenna for radio communication equipment is fixed to the second extending sections 121*b*, 121*c* of the ground horizontal surface section 121 using screws 401 and 402. A printed board 301 is held between upper and lower housings each covering the radio section of the radio communication equipment after. The first extending section 121*a* of the ground horizontal surface section 121 is then electrically connected by soldering or the like to a ground potential terminal of the printed board 301 on which circuit components of the radio section in the radio communication equipment are mounted. An extending section 103*a* of the auxiliary erecting surface section 103 is also electrically connected to an input and output terminal configured for transmitting and receiving signals by the printed board 301. With this feature, the work required for mounting an antenna for radio communication equipment onto a housing becomes easier and simpler.

Figure 3:
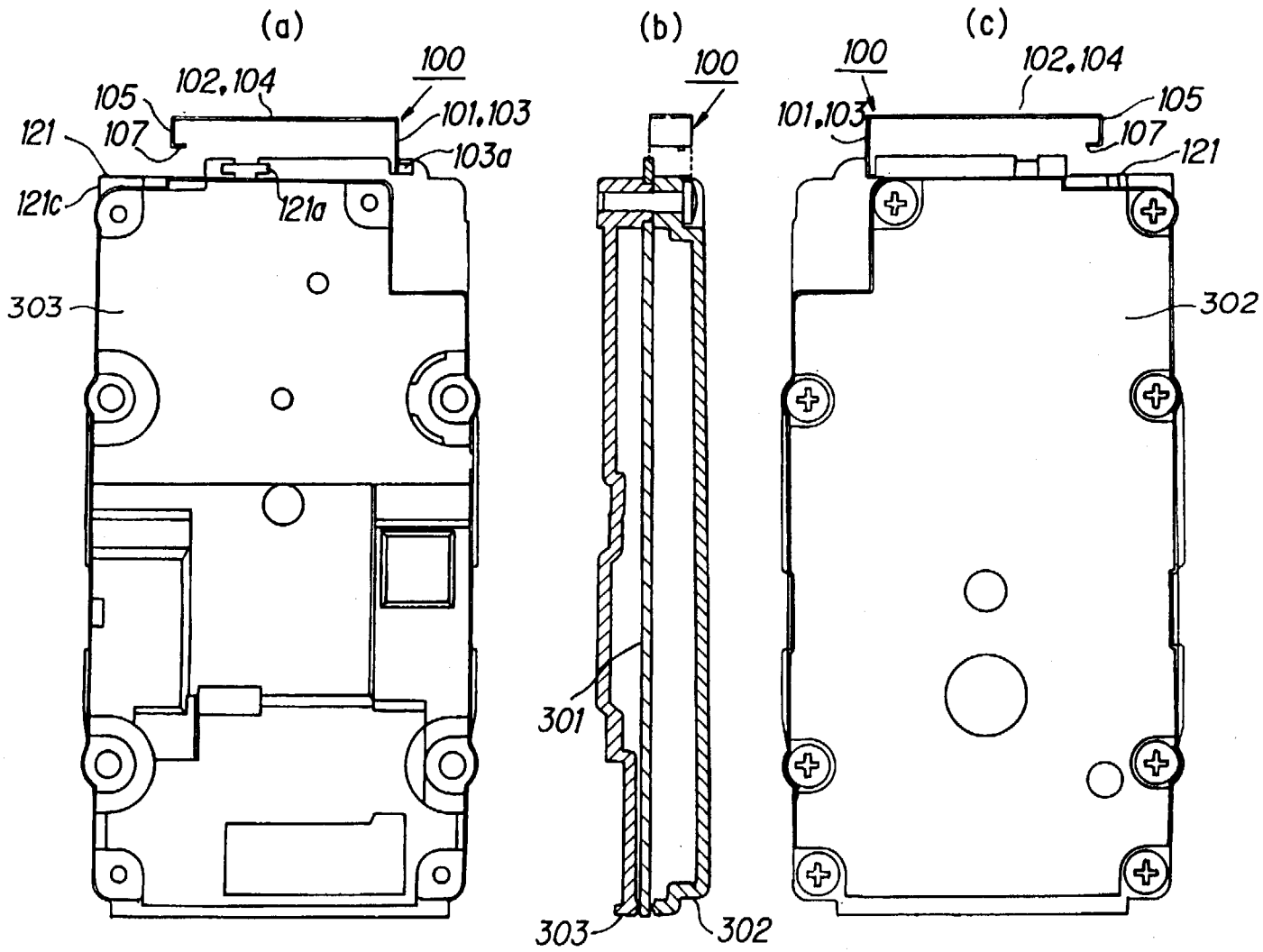
FIG. 3(*a*) is a bottom plan view of an antenna, according to the present invention, that has been mounted on a housing.

FIGS. 3(*a*)–3(*c*) show the antenna 100 according to one of the embodiments of the present invention (shown in FIG. 1(*b*), 1(*c*) and FIG. 2) applied to a PHS (Personal Handy Phone System) terminal unit. FIG. 3(*a*) is a bottom plan view illustrating the antenna 100 mounted on shield housings 302 and 303. FIG. 3(*b*) is a cross-sectional side view thereof, and FIG. 3(*c*) is a top plan view thereof.

In the PHS terminal unit, a request for size reduction of a unit form is extremely high. In the antennas 100 for radio communication equipment according to the embodiment of the present invention, as described above, impedance can be adjusted by (1) adjusting a distance between the auxiliary horizontal surface section 104 and the main horizontal surface section 102, (2) adjusting a length of the main horizontal surface section 102 or the auxiliary horizontal surface section 104, or the linking section 105, (3) adjusting an area ratio of the main horizontal surface section 102 vs. the auxiliary horizontal surface section 104, and (4) adjusting a length of the second extending section 107. Therefore, flexibility in adjusting impedance is extremely high, and it is possible that impedance can be designed to a desired value by adjustment in (1) to (4) described above even if there is any restriction for size reduction on the dimensional design for a height of the main erecting surface section 101 and auxiliary erecting surface section 103, or for a length of the main horizontal surface section 102 and auxiliary horizontal surface section 104.

In the configuration of the antenna based on the convention technology, the ground conductor connected to the main erecting surface section and the feeding point is constructed with top surfaces of the upper and lower shield housings 302, 303 each shown in FIG. 3. It is therefore difficult to form a ground potential surface facing to and uniformly in parallel to the main horizontal surface section 102 because the antenna either has stages as shown in the figure, or for some other reason. However, in the antenna 100 according to the embodiment of the present invention, the ground horizontal surface section 121 is provided substantially parallel to the main horizontal surface section 102, and is monolithically formed with other components of the antenna 100, so that such problem does not occur.

In designing the antenna 100 or a form of a shield housing 302, 303, the antenna itself can be freely designed without giving any restriction to other components, so that high designing flexibility for the whole radio communication equipment can be achieved.

FIG. 4 is an exploded view illustrating mounting of the antenna 100 onto the shield housing 302, 303. In the figure, designated at the reference numerals 401, 402 are mounting screws, at 301 a printed board on which circuit components of a radio section in a PHS terminal unit are mounted, at 302 an upper side shield housing for covering the radio section, and at 303 a lower side shield housing.

When mounting the antenna 100 for radio communication equipment according to the embodiment of the present invention onto the shield housing, the first extending section 121*a* of the ground horizontal surface section 121 is first electrically connected by soldering to a ground potential terminal of the printed board 301. The extending section 103*a* of the auxiliary erecting surface section 103 is also electrically connected to a terminal for input and output of transmitted and received signals of the printed board 301 each to be temporarily fixed to the printed board 301. Then, the second extending sections 121*b*, 121*c* of the ground horizontal surface section 121 and the printed board 301 each in the antenna 100 are fixed with the mounting screws 401 and 402 so that the two sections and the board are held between the upper side shield housing 302 and the lower side shield housing 303 that cover the radio section of the radio communication equipment.

Figure 5:
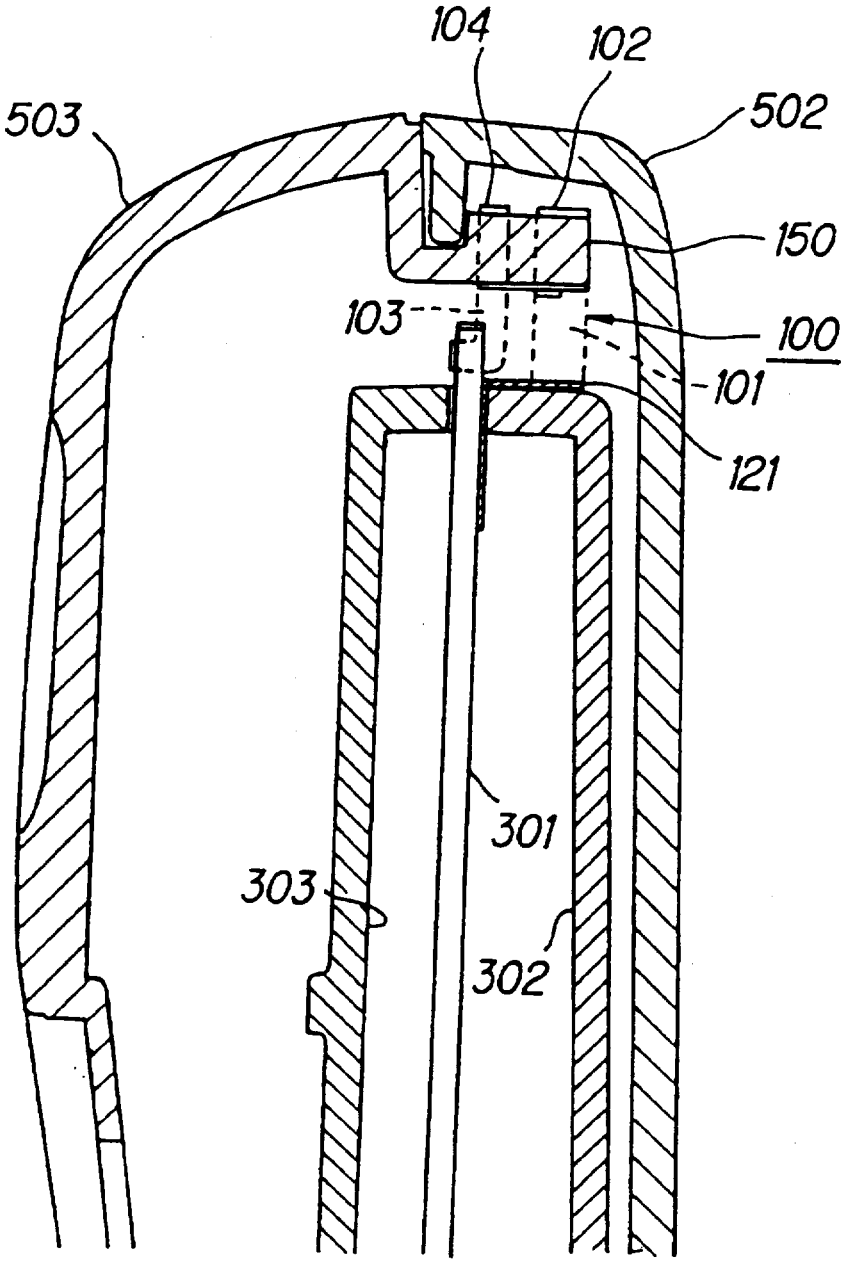
FIG. 5 is a cross-sectional view illustrating the housing construction of a radio section with the antenna for radio communication equipment mounted thereon is incorporated into a frame.

FIG. 5 is a cross-sectional construction view showing a PHS terminal unit when the housing of the radio section with the antenna 100 mounted thereon is incorporated in the frames 502, 503 of the PHS terminal unit.

As shown in FIG. 5, the antenna 100 is supported by a supporting section 150 which is square in its cross section. The supporting section 150 provided inside the frame 503, and is incorporated therein so that the peripheral four side faces of the supporting section 150 are covered with the components of the antenna 100. Thus, the main erecting surface section 101 and auxiliary erecting surface section 103 face the first side face of the supporting section 150. The main horizontal surface section 102 and auxiliary horizontal surface section 104 face the second side face. The linking section 105 faces the third side face, and the second extending section 107 faces to the fourth side face thereof respectively. With this feature, the antenna 100 can be securely fixed to the PHS terminal unit.

As described above, the second extending section 107 functions as a stopper for fixing the antenna 100 to the frame 503. The second extending section 107 also can adjust a central frequency in a resonance of the antenna by adjusting a length and a dimension of an area of the second extending section 107.

Figure 6:
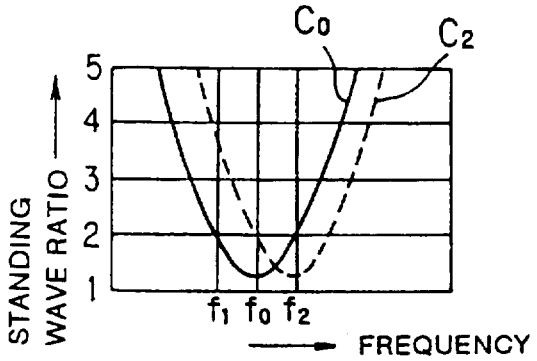
FIG. 6 is a graph illustrating adjustment of a central frequency in a resonance system of the antenna.
Figure 7:
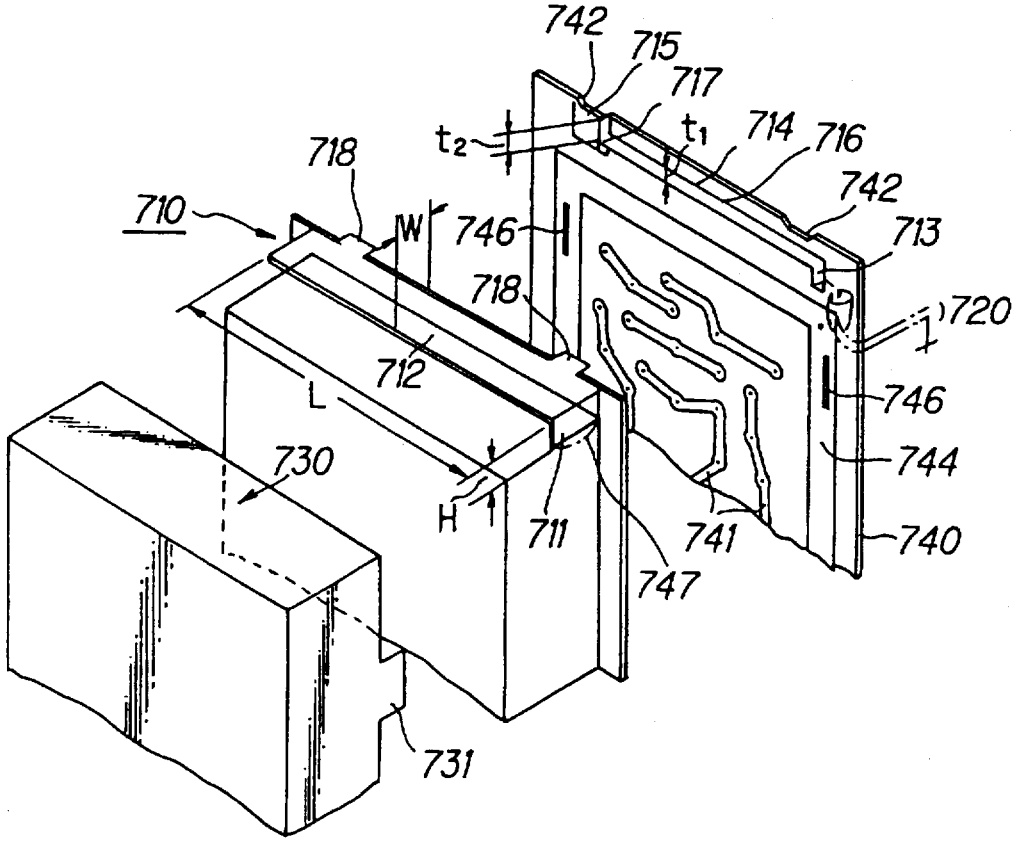
FIG. 7 is an exploded view illustrating a conventional type of antenna for radio communication equipment used with a cordless telephone set.

In a case where, for instance, a length or a dimension of an area of the second extending section 107 is set to an optimal value, it is assumed that a curve matching the central frequency f0, similar to the curve C0 indicated by the solid line shown in FIG. 6, can be obtained. In this case, when the length of the second extending section 107 is made shorter or the dimension of the area thereof is made smaller, the characteristics shifts to a higher frequency side as shown by the curve C2 (indicated by a dotted line). Conversely, when the length of the second extending section 107 is made longer or the dimension of the area thereof is made larger, the characteristics shift to a lower frequency side. Namely, in the antenna 100 for radio communication equipment according to the embodiment of the present invention, adjusting flexibility in a central frequency in a resonance system of the antenna can also be made higher.

As described above, with the antenna for radio communication equipment according to the first, second, third, fourth, fifth, sixth, seventh, eighth, ninth, and tenth features of the present invention, impedance can be adjusted in various manners, including: adjusting a specified space of the auxiliary horizontal linear section to the main horizontal surface section, adjusting a length of the main horizontal surface section or the auxiliary horizontal surface section, or of the linking section (or the linking section and the first extending section), and adjusting an area ratio by the main horizontal surface section as well as by the auxiliary horizontal surface section. Furthermore, with the antennas for radio communication equipment according to the first, second, third, fourth, fifth, sixth, and ninth features of the present invention, impedance can also be adjusted by adjusting a length of the second extending section. Therefore, it is possible to provide an antenna for radio communication equipment having extremely high flexibility in adjustment of impedance.

With the antenna for radio communication equipment according to the third, sixth, seventh, and eighth features of the present invention, the ground potential surface is provided substantially parallel with the main horizontal surface section, and is monolithically formed as a ground horizontal surface section with the other components in the antenna for radio communication equipment, so that only an antenna itself can be designed, whereby design flexibility as whole radio communication equipment can highly be achieved. In addition, the antenna is monolithically formed with a sheet of conductive plate, which makes it possible to provide an antenna for radio communication equipment excellent in manufacturing workability.

With the antenna for radio communication equipment according to the second, third, fifth and sixth features of the present invention, the antenna is incorporated in the frame so that the four side faces of the supporting section are covered with the components of the antenna for radio communication equipment. This makes it possible to provide an antenna for radio communication equipment which can be securely fixed to a PHS terminal unit or the like.

With the antenna for radio communication equipment according to the ninth feature of the present invention, a central frequency in a resonance system of the antenna can be adjusted by adjusting a length of the second extending section or a dimension of an area thereof. Accordingly, it is also possible to provide an antenna for radio communication equipment having high flexibility in the central frequency.

Furthermore, with the antenna for radio communication equipment according to the tenth feature of the present invention, it is possible to provide an antenna for radio communication equipment excellent in workability because of easier mounting work of the antenna onto housing.

INDUSTRIAL APPLICABILITY

As described above, the antenna for radio communication equipment according to the present invention is useful as a communication antenna for portable radio equipment which has been required to be down-sized such as a vehicle-mounted radio equipment or a transceiver, or further for a cordless telephone set, movable radio equipment, or portable radio equipment widely used nowadays.

We claim:

1. An antenna for radio communication equipment comprising:

a ground horizontal surface section for maintaining a ground potential;

a main erecting surface section having a first and second edge, said first edge thereof being connected to said ground horizontal surface section, and said main erecting surface section extending from said ground horizontal surface section at substantially right angles;

a main horizontal surface section having a first and second edge, said first edge thereof being connected to said second edge of said main erecting surface section, said main horizontal surface section extending from said main erecting surface section at substantially right angles and in a manner substantially parallel to said ground horizontal surface section;

a linking section having a first and second edge, said first edge thereof being connected to said second edge of said main horizontal surface section said linking section extending substantially perpendicular from said main horizontal surface section;

an auxiliary horizontal surface section having a first and second edge said first edge thereof being connected to said first edge of said linking section, said auxiliary horizontal surface section being positioned at a predetermined distance from said ground horizontal surface section and in a manner substantially parallel to said main horizontal surface section;

an auxiliary erecting surface section having a first and second edge, said first edge thereof being connected to said second edge of said auxiliary horizontal surface section and said second edge thereof being connected to said ground potential via a feeding point, said auxiliary erecting surface section extending in a manner substantially parallel to said main erecting surface section;

an extending section having a first and second edge, said first edge thereof being connected to said second edge of said auxiliary erecting surface section, said first extending section extending from said auxiliary erecting surface section at substantially right angles, said second end of said extending section being electrically connected to an input/output terminal of the radio communication equipment for transmitting and receiving radio frequency signals; and a second extending section having one edge thereof connected to said second edge of said linking section, said second extending section extending from said linking section at substantially right angles and in a manner substantially parallel to said ground horizontal surface section;

wherein said ground horizontal surface section, said main erecting surface section, said main horizontal surface section, said linking section, said auxiliary horizontal surface section, said auxiliary erecting surface section, said extending section, and said second extending section are monolithically formed from a sheet of conductive plate.

2. The antenna for radio communication equipment according to claim 1 further comprising a supporting section provided inside a frame for a main body of the radio communication equipment for providing supporting side faces, and wherein:

said main erecting surface section and said auxiliary erecting surface section face a first one of said supporting side faces;

said main horizontal surface section and said auxiliary horizontal surface section face a second one of said supporting side faces;

said linking section faces a third one of said supporting side faces; and said second extending section faces a fourth one of said supporting side faces.

3. The antenna for radio communication equipment according to claim 1 wherein a central frequency in a resonance system of said antenna is adjusted according to change in a length of said second extending section or a change in an area of said second extending section.

4. The antenna for radio communication equipment according to claims 1, wherein:

said antenna is connected to a base plate on which circuit components of a radio section in radio communication equipment are mounted;

said antenna is fixed with the second extending section of said ground horizontal surface section; and said base plate is held between upper and lower housings each covering the radio section of the radio communication equipment after the first extending section of said ground horizontal surface section is electrically connected to a ground potential terminal of said base plates and the extending section of said auxiliary erecting surface section is connected to said input/output terminal.

5. An antenna for radio communication equipment comprising:

a ground horizontal surface section for maintaining a ground potential;

a main erecting surface section having a first and second edge, said first edge thereof being connected to said ground horizontal section, and said main erecting surface section extending from said ground horizontal surface section at substantially right angles;

a main horizontal surface section having a first and second edge, said first edge thereof being connected to said second edge of said main erecting surface section, said main horizontal surface section extending from said main erecting surface section at substantially right angles and in a manner substantially parallel to said ground horizontal surface section;

a linking section having a first and second edge, said first edge thereof being connected to said second edge of said main horizontal surface section, said linking section extending substantially perpendicular from said main horizontal surface section; and an auxiliary horizontal surface section having a first and second edge, said first edge thereof being connected to said first edge of said linking section, said auxiliary horizontal surface section being positioned at a predetermined distance from said ground horizontal surface section and in a manner substantially parallel to said main horizontal surface section;

an auxiliary erecting surface section having a first and second edge, said first edge thereof being connected to said second edge of said auxiliary horizontal surface section and said second edge thereof being connected to said ground potential via a feeding point, said auxiliary erecting surface section extending in a manner substantially parallel to said main erecting surface section;

a second extending section having one edge thereof connected to said second edge of said linking section, said second extending section extending from said linking section at substantially right angles and in a manner substantially parallel to said ground horizontal surface section;

wherein said ground horizontal surface section, said main erecting surface section said main horizontal surface section, said linking section said auxiliary horizontal surface section, said auxiliary erecting surface section, said extending section, and said second extending section are monolithically formed from a sheet of conductive plate.

6. The antenna for radio communication equipment according to claim 5 further comprising a supporting section provided inside a frame for a main body of the radio communication equipment for providing supporting side faces, and wherein:

said main erecting surface section and said auxiliary erecting surface section face a first one of said supporting side faces;

said main horizontal surface section and said auxiliary horizontal surface section face a second one of said supporting side faces;

said linking section faces a third one of said supporting side faces; and said second extending section faces a fourth one of said supporting side faces.

7. An antenna for radio communication equipment comprising:

a ground horizontal surface section for maintaining a ground potential;

a main erecting surface section having a first and second edge, said first edge thereof being connected to said ground horizontal surface section, said main erecting surface section extending from said ground horizontal surface section at substantially right angles;

a main horizontal surface section having a first and second edge, said first edge thereof being connected to said second edge of said main erecting surface section, said main horizontal surface section extending from said main erecting surface section at substantially right angles and in a manner substantially parallel to said ground horizontal surface section;

a linking section having an edge thereof connected to said second edge of said main horizontal surface section, said linking section extending substantially perpendicular from said main horizontal surface section;

an auxiliary horizontal surface section having a first and second edge, said first edge thereof being connected to said first edge of said linking section, said auxiliary horizontal surface section being positioned at a predetermined distance from said ground horizontal surface section and in a manner substantially parallel to said main horizontal surface section; and an auxiliary erecting section having a first and second edge, said first edge thereof being connected to said second edge of said auxiliary horizontal surface section and said second edge thereof being connected to the ground potential via a feeding point, said auxiliary erecting surface section extending in a manner substantially parallel to said main erecting surface section;

wherein said ground horizontal surface section, said main erecting surface section, said main horizontal surface section, said auxiliary erecting section, said auxiliary horizontal section, and said linking section are monolithically formed from a sheet of conductive plate.

8. The antenna for radio communication equipment according to claim 7 wherein said linking section further includes a second edge connected to said ground horizontal surface section.

* * * * *